United States Patent [19]

Aubert

[11] Patent Number: 4,704,052

[45] Date of Patent: Nov. 3, 1987

[54] FOUNDATION AND METHOD FOR IMPROVING THE RESISTANCE TO SLIDING OF CIVIL ENGINEERING STRUCTURES

[75] Inventor: Jean Aubert, Paris, France

[73] Assignee: Nancy de la Perriere, Paris, France

[21] Appl. No.: 942,967

[22] Filed: Dec. 16, 1986

Related U.S. Application Data

[63] Continuation of Ser. No. 199,299, Oct. 21, 1980, abandoned.

[30] Foreign Application Priority Data

Nov. 6, 1979 [FR] France ..... 79 27297

[51] Int. Cl.[4] ..... E02B 7/00; E02D 5/20; E02D 27/30; E02D 29/06

[52] U.S. Cl. ..... 405/229; 405/107; 405/222; 405/280

[58] Field of Search ..... 405/102, 107, 195, 110–112, 405/225, 222, 229, 280

[56] References Cited

U.S. PATENT DOCUMENTS

| | | | |
|---|---|---|---|
| 851,436 | 4/1907 | Pyle | 405/280 |
| 1,007,717 | 11/1911 | McGill | 405/280 |
| 1,742,947 | 1/1930 | Brash | 405/280 |
| 3,720,067 | 3/1973 | Aubert | 405/107 |

FOREIGN PATENT DOCUMENTS

| | | | |
|---|---|---|---|
| 2190129 | 1/1974 | France | 405/107 |

*Primary Examiner*—Nancy J. Stodola

*Attorney, Agent, or Firm*—James P. Ryther; H. Duane Switzer

[57] ABSTRACT

A foundation for a retaining wall-type of structure acted upon by a principal force tending to slide same in a predetermined direction is anchored by a plurality of slide resisting walls. The slide resisting walls extend parallel to the predetermined direction in which the foundation tends to slide. The upper portions of the slide resisting walls are embedded in a concrete mass. The lower portions of the slide resisting walls project downwardly from the concrete mass into the earth, and are solely in engagement with the earth and not with concrete.

13 Claims, 4 Drawing Figures

FOUNDATION AND METHOD FOR IMPROVING THE RESISTANCE TO SLIDING OF CIVIL ENGINEERING STRUCTURES

This application is a continuation of application Ser. No. 199,299, filed 10-21-80, now abandoned.

This invention relates to foundations for methods improving the resistance to sliding of civil engineering structures such as retaining wall-type of structures, which would otherwise be liable to undergo a displacement in a predetermined direction by reason of the principal horizontal forces to which they are subjected.

The principal horizontal force mentioned above appear in particular when the structure under consideration is subjected on two opposite faces to different pressures of water and thus performs the function of a dam.

Similar principal horizontal forces appear when a structure built on land is subjected to earth pressure.

In both of the cases mentioned in the foregoing, the structure is liable to slide on the ground on which it rests. The risk is small in the case of rocky or alluvial soil of good quality and having a satisfactory angle of internal friction. It is a different matter if the soil is more or less clayey or muddy.

The method of consolidation of foundations by means of one or a number of cross-walls or slide resisting walls which form the subject of the present invention has a very general character. The method will clearly assume different forms according to the type of structure which is considered for the principal horizontal forces tending to move the structure in a predetermined direction, and the foundation of which is intended to be consolidated. Its application will be described in the case of the particular type of structure which formed the subject of French Pat. No. 2,190,129 filed on June 22, 1972.

This known method consists in submerging a platform in water so as to cause said platform to rest on two parallel sheet-pile walls which have been driven into the ground. Concrete is then placed by casting in situ beneath the platform in such a manner as to fill the space formed between the ground, said platform and the two sheet-pile walls. The resultant concrete mass thus constitutes a foundation for the dam body.

One of the sheet-pile walls is located vertically below the upstream face of the dam whilst the other sheet-pile wall is disposed along the downstream face. The strength of the foundations thus formed depends partly on the resistance of the two parallel sheet-pile walls which are anchored in the ground. It will be noted, however, that these two sheet-pile walls work at right angles to their own plane and are consequently liable to deform.

The method in accordance with the invention is distinguished by the fact that, before sinking the platform, a certain number of sheet-pile walls known as cross-walls or slide resisting walls are driven into the ground between two parallel sheet-pile walls known as cutoff walls or support walls, and are substantially perpendicular to these latter. Said cross-walls or slide resisting walls can advantageously be joined to the first two walls by means of special sheet-piles.

The level of the top edge of the sheet-pile cross-walls or slide resisting walls is slightly lower than the level of the lower end of the platform girder system. Before driving said cross-walls or slide resisting walls into the ground, it may prove necessary as a preliminary operation to dredge the ground to a level below the top edge of the future sheet-pile cross-wall or slide resisting wall so as to ensure that the upper portion of the cross-wall or slide resisting wall will project freely above ground level. During filling with concrete which is cast in situ, said upper portion of the sheet-pile cross-walls or slide resisting walls will therefore be embedded in the concrete.

In consequence, the sheet piles of the cross-walls or slide resisting wall will not be liable to slide with respect to each other under the action of a principal horizontal force exerted in the plane of (parallel to) the cross-wall or slide resisting wall involved. Since the sheet piles are in no way liable to be subjected to a relative displacement in sliding motion and are joined together by means of their locks, said sheet piles accordingly constitute a high-strength, non-deformable and monolithic wall which could undergo a displacement only as a single unit.

As a further consequence, a connection is established between the sheet-pile cross-wall and the massive concrete foundation raft in which the girder system of the floor structure is embedded. This connection could be broken only in the event of shearing of large concrete surfaces.

Moreover, since the cross-wall or slide resisting wall would be capable of displacement in its own plane with respect to the ground only under the action of forces which are considerably larger than those corresponding to the maximum load to be resisted, the concrete foundation raft of the floor structure will consequently be securely anchored in the ground.

The invention is also directed to the submerged foundation constructed by means of the method which has been outlined in the foregoing.

The submerged foundation comprises two parallel sheet-pile support walls anchored in the ground, a platform which rests on these two sheet-pile support walls and a massive concrete foundation raft which fills the space formed between the ground, said two parallel sheet-pile walls and said platform.

In accordance with the invention, said foundation essentially comprises in addition sheet-pile cross-walls or slide resisting walls, the upper portion of said cross-walls or slide resisting walls being embedded in the massive concrete foundation raft.

These and other features of the invention will be more apparent to those skilled in the art upon consideration of the following description and accompanying drawings, wherein.

Figure 1:
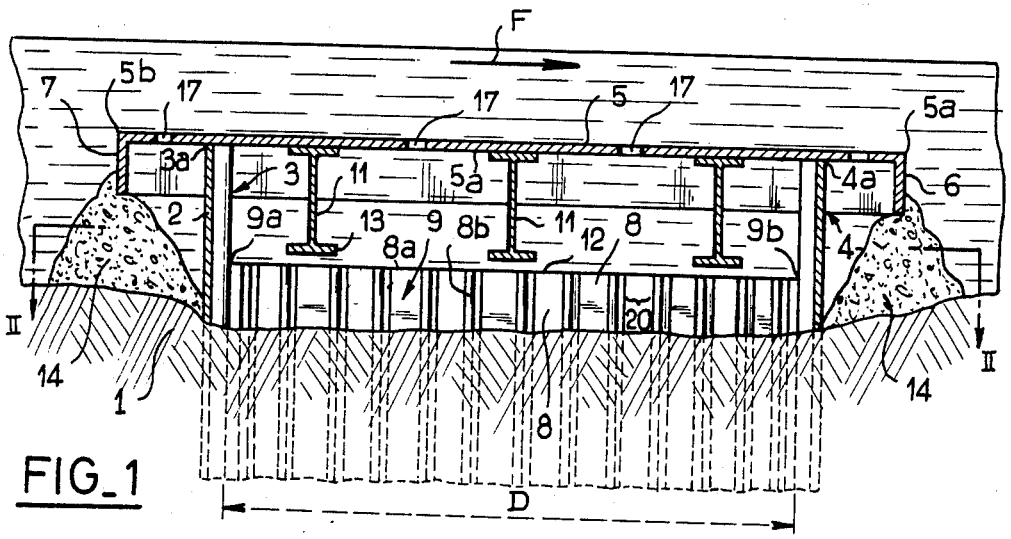
FIG. 1 is a diagrammatic transverse view showing a platform in accordance with the invention which rests on two parallel sheet-pile walls prior to formation of the massive concrete foundation raft.

In order to construct submerged sea or river foundations for the floor structure of a movable dam or for the support base of a civil enginering structure, it may prove necessary at the outset to perform a dredging operation. A series of sheet piles 2 are then driven into the ground 1 so as to form two parallel sheet-pile support walls 3 and 4 which are substantially perpendicular to the direction of flow F of the watercourse (as shown in FIG. 1). The sheet-pile wall 3 is placed upstream with respect to the sheet-pile wall 4 relatively to the aforesaid direction of flow F of the watercourse.

Figure 2:
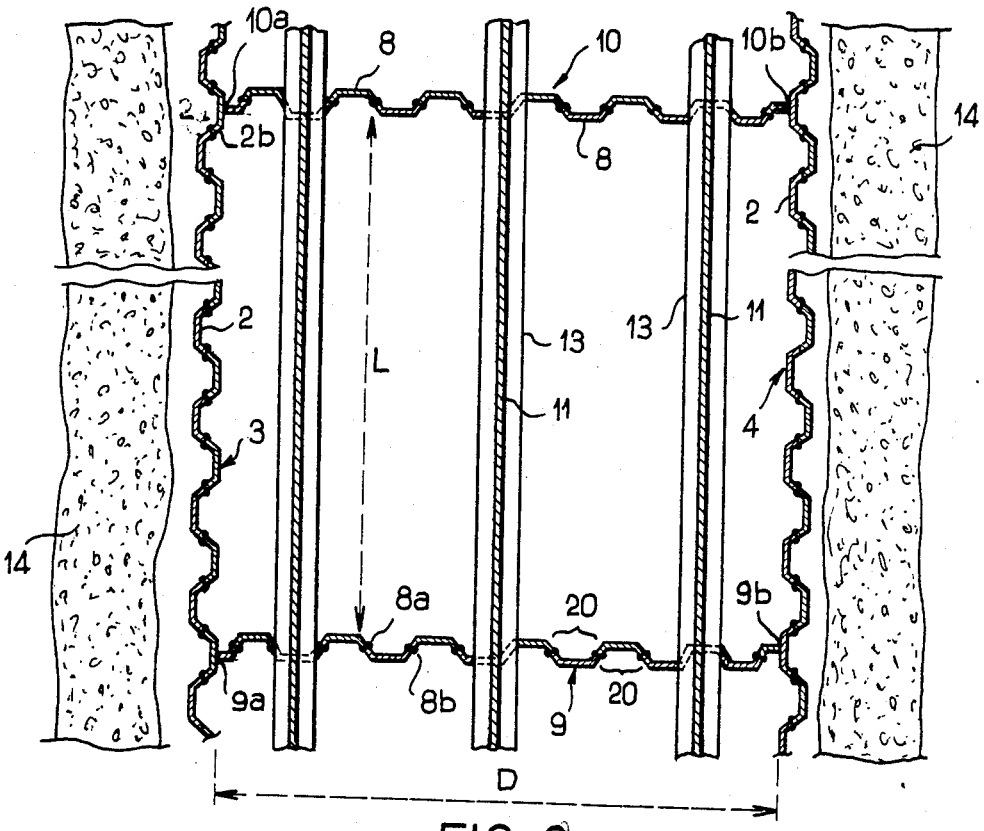
FIG. 2 is a sectional view taken along the plane II—II of FIG. 1.

The sheet piles 2 of the walls 3 and 4 are joined together by means of their locks 2*a*, 2*b*, as shown in FIG. 2.

The parallel sheet-pile walls 3 and 4 are intended to serve as a support for a platform 5, the longitudinal edges 5*a*, 5*b* of which are bent back so as to form downwardly-directed flanges 6 and 7.

Before placing said platform 5 in position on the sheet-pile walls 3 and 4, a series of sheet piles 8 is driven into the ground 1 between the parallel walls 3 and 4 so as to form cross-walls or slide resisting walls 9, 10 at right angles to the walls 3 and 4. Said sheet piles 8 are joined together by means of their locks 8*a*, 8*b* whilst the ends 9*a*, 9*b*, 10*a*, 10*b* of said cross-walls 9, 10 are preferably joined to the two parallel walls 3 and 4. The channels 20 of the different sheet-pile walls open alternately in opposite directions.

In the case of the embodiment shown in the drawings, the platform 5 is provided on its bottom surface 5*a* with a system of girders which has the essential function of ensuring rigidity of the sheet metal and which is represented diagrammatically by the girders 11. The sheet piles 8 of the cross-walls or slide resisting walls 9, 10 are driven into the ground until the level of the top sheet-pile edges 12 is located slightly below the level of the bottom flanges 13 of the girders 11.

When the platform 5 has been placed on the sheet-pile walls 3 and 4, masses 14 of alluvial soil are formed along said walls against the side flanges 6 and 7 of the platform 5 in order to fill-up the space formed between the ground 1 and said side flanges 6 and 7.

Figure 3:
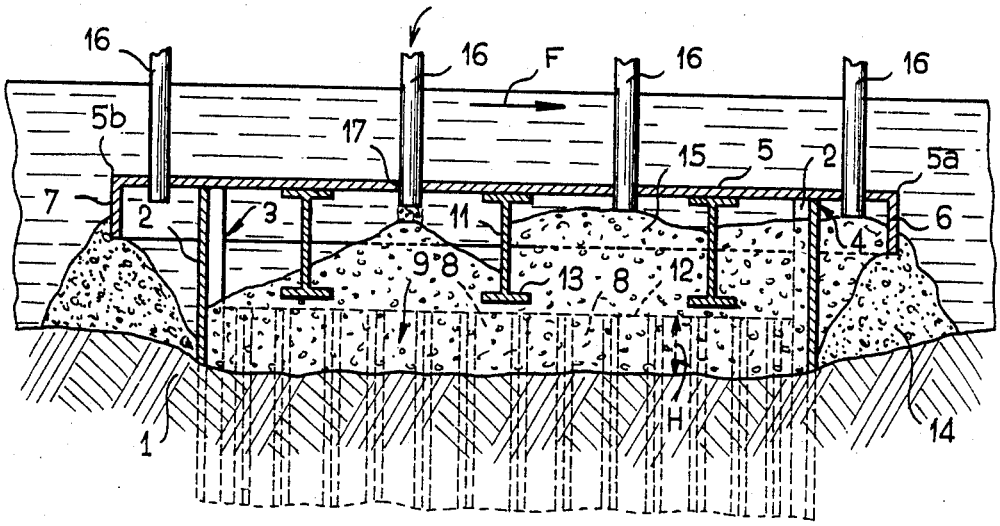
FIG. 3 is a view which is similar to FIG. 1 and shows the placement of the concrete beneath the platform.

Concrete 15 is then poured into the substantially closed space located between the platform 5, the ground 1 and the massive embankments 14 (see FIG. 3) as described in French Pat. No. 2,190,129 filed by the present Applicant on June 22, 1972. This operation can be performed by means of concrete injection nozzles 16 which are engaged within openings 17 formed in the platform 5.

When the mass of concrete 15 has been allowed to set, the platform 5 is securely attached to the concrete and stiffened by means of the system of girders.

Furthermore, the upper portion of the sheet piles 8 constituting the cross-walls or slide resisting walls 9, 10 is completely embedded in the mass of concrete 15.

Figure 4:
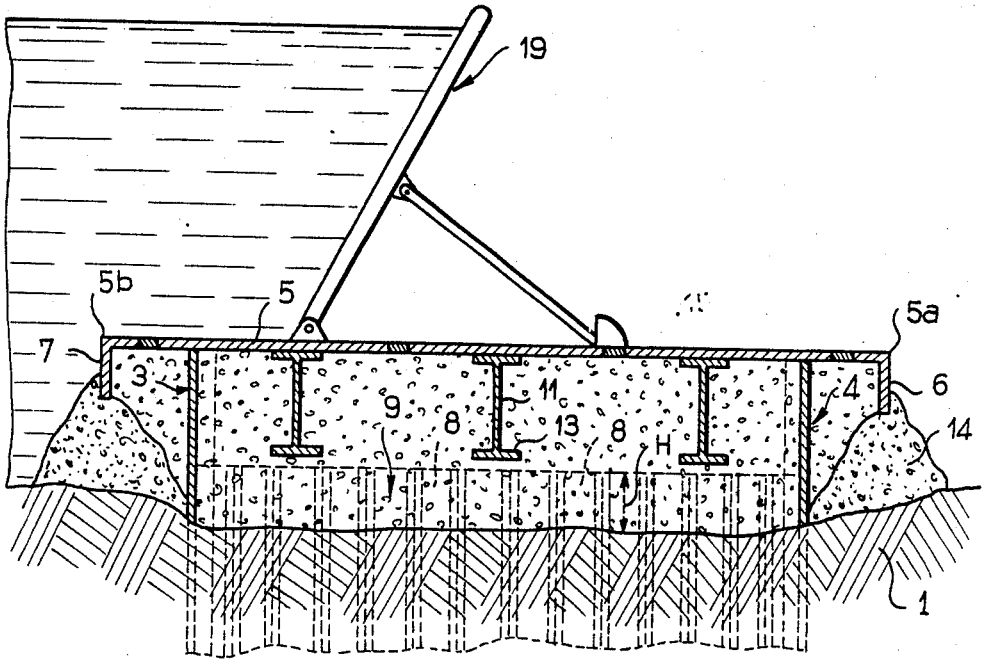
FIG. 4 is a diagrammatic sectional view showing the application of the invention to the construction of a foundation for a movable dam.

The foundation thus obtained can accordingly serve as a sub-foundation for a dam body or can constitute the floor structure of a wicket-type movable gate system 19 (shown in FIG. 4).

The sheet-pile cross-walls or slide resisting walls 9, 10 which are placed between the upstream sheet-pile support wall 3 and the downstream sheet-pile support wall 4 considerably increase the resistance of the foundation to sliding which could otherwise take place as a result of forces exerted by the pressure of water in a direction at right angles to said upstream and downstream sheet-pile support walls 3 and 4.

The resistance just mentioned results on the one hand from the connection established between the sheet-pile cross-walls or slide resisting walls 9, 10 and the ground 1 and, on the other hand, from the connection established between said cross-walls or slide resisting walls 9, 10 and the massive concrete foundation block 15 to which the floor structure is rigidly fixed.

By virtue of the channels 20 formed by the juxtaposed sheet piles 8, the cross-walls 9, 10 each offer a considerable and even practically infinite resistance to a displacement in a direction parallel to the plane or length of said cross-walls or slide resisting walls.

Resistance to sliding of the foundation with respect to a principal horizontal force applied in a direction parallel to the sheet-pile cross-walls or slide resisting walls 9, 10 increases with the number of cross-walls or slide resisting walls 9, 10. Said resistance is higher as the distance L (see FIG. 2) between two adjacent cross-walls or slide resisting walls 9, 10 is shorter. Between two cross-walls, or slide resisting walls the floor structure constitutes a beam having a height corresponding to a large fraction of the bearing distance.

Moreover, good conditions of anchoring of the concrete foundation raft 15 to the ground 1 are achieved when the upper portion of the sheet piles 8 constituting the cross-walls or slide resisting walls 9, 10 is embedded in the concrete mass 15 over a distance or height H within the range of 0.30 to 1 m.

As will readily be apparent, the invention is not limited to the example hereinabove described and many modifications can accordingly be contemplated without thereby departing either from the scope or the spirit of the invention.

Thus the invention is also applicable to the case of retaining wall-type of structures having non-submerged foundations which rest on sliding ground and are liable to be subjected to large forces having a horizontal component such as that which could result from earth pressure.

In non-submerged foundations of this type, the use of the platform 5 for pouring the concrete 15 is clearly not necessary. In many instances, the cutoff sheet-pile walls could also be dispensed with.

Moreover, in order to construct a high-strength, non-deformable and monolithic cross-wall, it would be possible to dispense with the use of metallic sheet piles and to resort to the well-known technique of bearing-walls which are molded in the ground and on which a wall of reinforced concrete is then constructed directly.

What is claimed is:

1. A foundation for a retaining wall-type of structure for holding back a mass which acts on the structure with a principal horizontal force tending to cause said foundation to slide relative to the earth in a predetermined direction, said foundation comprising: a plurality of slide resisting walls extending generally parallel to said predetermined direction, said slide resisting walls being spaced-apart transversely of said predetermined direction, said slide resisting walls having lower portions embedded in the earth and upper portions extending upwardly out of the earth, and a concrete mass covering said upper portions of said slide resisting walls and occupying the spaces therebetween to form a foundation, said lower portions of said slide resisting walls projecting downwardly from said concrete mass into the earth and being solely in engagement with the earth and not with concrete, whereby sliding movement of said foundation in said predetermined direction is resisted by the interlocking relationship between said concrete mass and said upper portions of said slide resisting walls and by the resistance to sliding of said lower portions of said slide resisting walls relative to the earth in a direction parallel to the length of said slide resisting walls by virtue of said lower portions of said slide resisting walls being embedded in the earth.

2. The foundation of claim 1 wherein each said slide resisting wall is defined by a plurality of interlocking metallic sheet-piles.

3. The foundation of claim 1 including a pair of support walls extending generally perpendicular to said slide resisting walls and located such that said slide resisting walls extend therebetween, all of said walls having upper ends, and said upper ends of said support walls being located above said upper ends of said slide resisting walls.

4. The foundation of claim 3 including a platform supported on said upper ends of said support walls, said concrete mass occupying substantially the entire space beneath said platform.

5. The foundation of claim 4 wherein said platform includes a plurality of spaced-apart girders extending substantially perpendicular to said slide resisting walls and spaced above same, said girders being embedded in said concrete mass.

6. The foundation of claim 3 wherein said slide resisting walls are spaced-apart from one another about 5–10 times the distance between said support walls.

7. The foundation of claim 1 wherein said upper portions of said slide resisting walls project upwardly out of the earth about 0.30 to 1 meters.

8. A method of constructing a foundation for a retaining wall-type of structure which holds back a mass exerting a principal horizontal force on such structure tending to cause said foundation to slide relative to the earth in a predetermined direction, comprising the steps of: forming a plurality of spaced-apart slide resisting walls extending generally parallel to said predetermined direction by embedding lower portions of such walls in the earth while leaving upper portions thereof projecting upwardly out of the earth, covering said upper portions of said slide resisting walls and filling the spaces therebetween with a concrete mass to form a foundation while leaving said lower portions of said slide resisting walls projecting downwardly from said concrete mass into the earth and being solely in engagement with the earth and not with concrete, and allowing said concrete mass to harden for interlocking same with said upper portions of said slide resisting walls and thereby providing resistance to sliding movement of said foundation in said predetermined direction.

9. The method of claim 8 including the step of forming a pair of spaced-apart support walls extending substantially perpendicular to said predetermined direction by embedding lower portions of such walls in the earth while leaving upper portions thereof projecting upwardly out of the earth, and said step of forming such slide resisting walls being carried out by forming same between said support walls.

10. The method of claim 9 wherein said support walls and slide resisting walls have upper ends and said steps of forming said walls are carried out such that said upper ends of said support walls are spaced above said upper ends of said slide resisting walls.

11. The method of claim 10 including the step of supporting a platform on said upper ends of said support walls prior to said step of covering said upper portions of said slide resisting walls with concrete.

12. The method of claim 11 wherein said step of supporting a platform on said upper ends of said support walls is carried out by providing a platform having girders spaced above said upper ends of said slide resisting walls, and said step of covering said upper portions of said slide resisting walls being carried out by also embedding said girders in such concrete.

13. The method of claim 8 including the step of supporting a platform independently of and spaced above said upper ends of said slide resisting walls prior to said step of covering said upper portions of said slide resisting walls with concrete.

* * * * *